United States Patent [19]

Wright

[11] Patent Number: 4,747,398

[45] Date of Patent: May 31, 1988

[54] PRESSURE ADJUSTMENT APPARATUS

[75] Inventor: Edward S. Wright, Allegheny, Pa.

[73] Assignee: Wright Linear Pump, Inc., Imperial, Pa.

[21] Appl. No.: 28,469

[22] Filed: Mar. 20, 1987

[51] Int. Cl.[4] ..... A61H 7/00

[52] U.S. Cl. ..... 128/64; 128/44; 128/24 R

[58] Field of Search ..... 128/64, 44, 60, 24 R; 137/883, 882, 865

[56] References Cited

U.S. PATENT DOCUMENTS

| | | | |
|---|---|---|---|
| 268,971 | 12/1882 | Abbott | 137/865 |
| 2,328,029 | 8/1943 | Porter | 137/865 |
| 3,038,496 | 6/1962 | Ruschhaupt | 137/865 |
| 3,179,106 | 4/1965 | Meredith | 128/64 |
| 3,509,912 | 5/1970 | James | 137/865 |
| 3,866,604 | 2/1975 | Curless et al. | 128/64 |
| 4,253,449 | 3/1981 | Arkans et al. | 128/64 |
| 4,370,975 | 2/1983 | Wright | 128/64 |

*Primary Examiner*—Edgar S. Burr
*Assistant Examiner*—Tonya Lamb
*Attorney, Agent, or Firm*—Carothers & Carothers

[57] ABSTRACT

An adjustment apparatus for adjusting the pressure applied in the multiple cells of an inflatable medical garment with the pressure adjustment being achieved by a drive apparatus interconnecting adjustable pressure regulating devices, the drive apparatus and the respective pressure regulating devices including adjustment elements which permit adjustment of each pressure regulating device independently of others of the pressure regulating devices such that the drive apparatus may be utilized to adjust, in unison, multiple pressure regulating devices having selectively variable pressure differential relationship between any pair of the multiple pressure regulating devices.

11 Claims, 1 Drawing Sheet

PRESSURE ADJUSTMENT APPARATUS

BACKGROUND OF THE INVENTION

Figure 1:
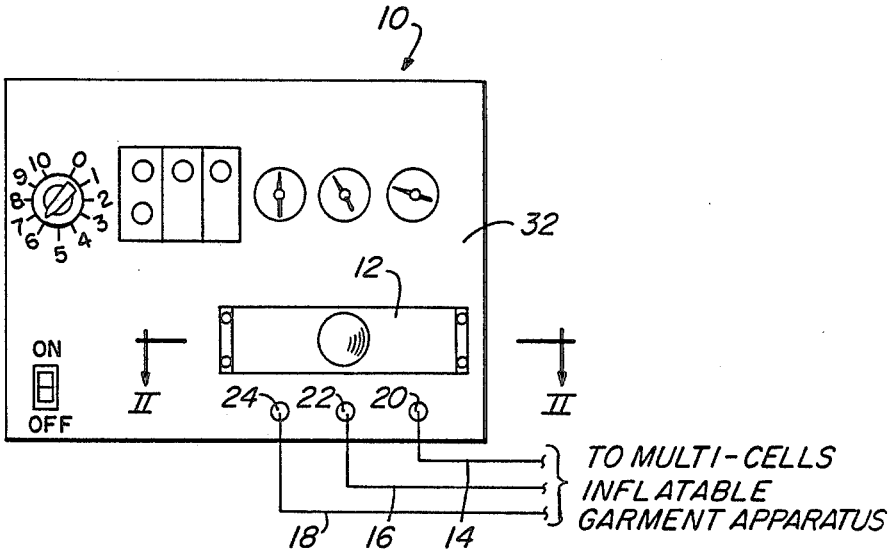

It is well known in the medical arts that the treatment of certain physical conditions benefits markedly by the application of pressure to a body extremity such as an arm or a leg in a manner to promote the flow of a body fluid within the same from a distal portion thereof toward a proximal portion thereof. For example, the affliction known as Park-Weber Syndrome often may cause a limb of the afflicted to swell to a size much greater than normal size as lymphatic fluid accumulates in the limb. One prior mode of treatment for this affliction has been a double walled sheath or stocking in which air pressure is introduced between the walls to squeeze the limb. It has been found that this and other such systems which rely on uniform pressure application throughout the length of the afflicted limb do not perform very well and in fact may interfere with the desired distal-to-proximal flow of lymphatic fluid.

Other approaches to treatment of Park-Weber syndrome are disclosed as a sheath that is separated into a number of longitudinally spaced inflatable air cells encircling the limb to be treated. These cells are inflated by uniform air pressure successively from the distal end to the proximal end of the sheath with the intent of promoting fluid flow in the desired direction. However, many of these systems too have been ineffectual as they rely on pressure being maintained at the same level in all the pressurized cells. U.S. Pat. Nos. 2,533,504 and 2,781,041 disclose examples of such systems.

My prior U.S. Pat. No. 4,370,975 discloses an apparatus for treating Park-Weber Syndrome and similar afflictions through the use of a multi-cell sheath which encompasses the swollen limb. Pressure is applied in the cells of the sheath in timed sequence from the distal-most cell to the proximal-most cell, the sequence of pressures applied also defining a decreasing gradient pressure from a maximum pressure applied in the distal-most cell to a minimum pressure applied in the proximal-cell when all of the cells are pressurized. Generally, for each pair of adjacent cells, the more distal of the pair has applied therein a higher pressure than the more proximal of the pair. This application of pressure from distal to proximal cells in timed sequence, as described, comprises a cycle, and such cycle may be repeated indefinitely.

Prior to introduction of the technology disclosed by my cited prior patent, the art did not contemplate such a pressure gradient from cell to cell in an inflatable appliance, and therefore no need for precise and uniform adjustment of the cell-to-cell pressure differential had been recognized. Such need has now become apparent as it appears in many instances the pressure gradient from one cell to the next, that is the pressure differential therebetween, should remain uniform with only the magnitudes of the various cell pressures being varied, in a uniform manner, to adapt the treatment for a particular patient. This being the case, I have invented a pressure adjustment apparatus for use in such a system which permits adjustment of the magnitude of air pressure delivered to the respective cells of a multi-cell inflatable apparatus while maintaining a uniform pressure differential between any given pair of cells. That is to say, the pressure differential between a given pair of cells remains constant as pressure adjustments are made. The pressure differential between other pairs of adjacent cells may differ from that for such a given cell, but these too will remain constant during cell pressure adjustments.

Clearly, the pressure adjustment apparatus should offer not only this uniform adjusting capability, but in addition the option for adjusting the cell-to-cell pressure differential when desired, as well as a simple and quickly performed pressure adjustment procedure to simplify operation of the apparatus and thereby reduce requirements for direct supervision by an attending physician.

BRIEF SUMMARY OF THE INVENTION

The present invention provides an apparatus as above characterized with improved structure for pressure regulator adjustment wherein a single manually operable mechanical control is provided to simultaneously adjust the pressure applied in each of multiple cells of an inflatable medical appliance in a manner that a specified pressure differential as between any pair of the multiple cells is maintained at a uniform level throughout such adjustments. The invention also provides for adjustment of such pressure differentials as deemed desirable such that, for any set of selected pressure differentials as between the various ones of the multiple cells, the selected pressure differentials are maintained continuously and uniformly throughout adjustment of the magnitude of applied pressure levels in the respective cells.

A presently preferred embodiment of the invention comprises a chain and sprocket or similar drive arrangement for imparting rotary adjustment impetus from a selected one of several rotationally adjustable pressure regulators to other of such pressure regulators. The respective sprockets preferably provide a one-to-one drive ratio such that, with identical pressure regulators, manual adjustment of one of the pressure regulators correspondingly adjusts each of the other pressure regulators.

Preferably, one pressure regulator includes a handle, knob, or similar manual adjustment element which protrudes beyond a cover member that covers the remaining pressure regulators. This eliminates confusion as to pressure adjustment procedures by presenting the operator with only a single manually operable adjustment entity for pressure adjustment. The cover member preferably is readily removable to permit adjustment of the cell-to-cell pressure differentials as desired.

Figure 2:
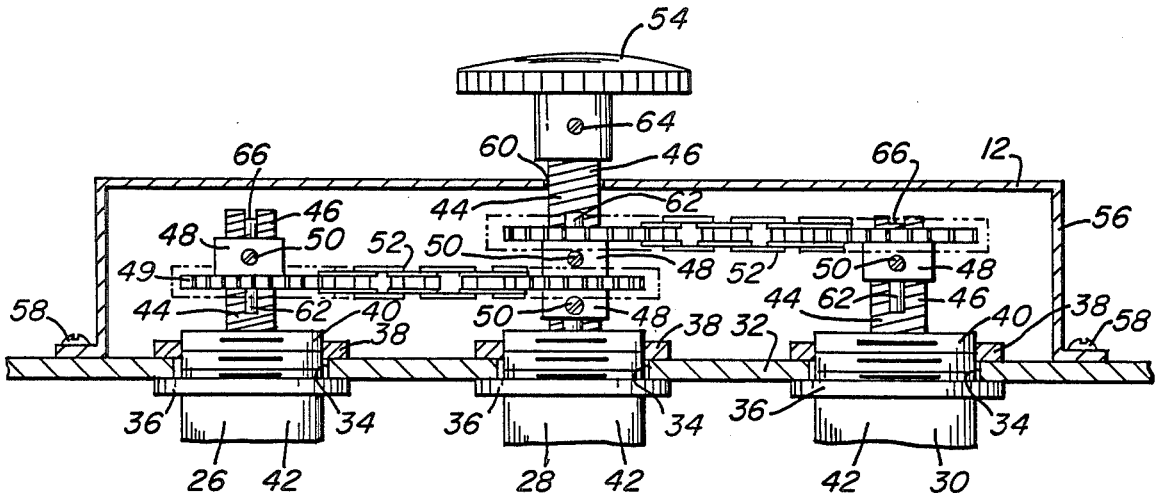

The invention will be more clearly understood upon consideration of the following detailed description and the accompanying figures, in which:

FIG. 1 is a generally schematic frontal elevation of the control panel for an air pump apparatus which operates a multi-cell, inflatable medical apparatus such as above characterized, and including pressure adjustment apparatus according to the present invention; and FIG. 2 is a fragmentary section taken on line II—II of FIG. 1.

There is generally indicated at 10 in FIG. 1 an apparatus such as is characterized in my above-cited prior of U.S. Pat. No. 4,370,975, and including pressure adjustment means 12 of the instant invention. As shown in FIG. 1, fluid pressure conducting conduits 14, 16 and 18 are connected to respective pressure outlets 20, 22 and 24 on apparatus 10 to convey fluid pressure such as air pressure to a multi-cell inflatable medical device, also as disclosed in my above cited prior patent.

Inasmuch as the apparatus 10 is known in the prior art, further detailed description thereof is believed unnecessary for an understanding of the present invention; however, to the extent such detailed description may be deemed necessary, it will be found in my prior U.S. Pat. No. 4,370,975, the entire disclosure of which is hereby incorporated herein and made a part hereof by reference.

As it is disclosed in my cited prior patent, there is provided upstream of each pressure fluid outlet 20, 22 and 24, a respective pressure regulator 26, 28 and 30 (FIG. 2) which regulates the pressure supplied to the respective line 14, 16, and 18, to the multi-cell inflatable apparatus.

The pressure regulators 26, 28 and 30 are identical regulator devices, each preferably mounted in the front panel 32 of apparatus 10 as by protruding through respective openings 34 to be secured therein by clamping the panel 32 between a regulator body flange portion 36, and a securing nut 38 which is threaded onto the forwardmost end portion 40 of the respective pressure regulator boides 42.

Projecting outwardly of each respective forwardmost end 40 is a rotary adjustment stem 44, with one such stem 44 being longer than and projecting further outwardly than the stems 44 of the remaining pressure regulators. In FIG. 2, the longer stem 44 is provided for pressure regulator 28. Each stem 44 may be provided with external threads 46 to receive in threaded engagement thereon a drive sprocket 48, or in the case of pressure regulator 28, a pluality of drive sprockets 48, that is one for each of the remaining pressure regulators to be driven thereby. Each sprocket 48 is provided with a set screw 50 which may be manually tightened down into radial engagement with the respective stem 44 to fixedly secure the respective sprocket with respect to the stem. A roller chain 52 encircles each drive sprocket 48 on the elongated stem 44 of pressure regulator 28, and the respective drive sprocket 48 of one of the remaining pressure regulators 26 and 30, to thereby provide a rotary driving connection between the respective connected stems 44. Preferably, all of the drive sprockets 48 are sized to provide a one-to-one driving ratio such that with the use of pressure regulators having identical adjustment characteristics, the chain and sprocket drive arrangement will provide for uniform adjustment of the multiple pressure regulators through adjustment of a single one of the same.

To accommodate this, the elongated stem 44 of regulator 28 receives on the outermost end thereof a knob 54 or similar manually operable control to permit adjustment of the pressure regulator 28, with adjustment of regulators 26 and 30 occurring simultaneously through the action of the described chain and sprocket arrangement. Preferably, a cover member 56 covers the multiple pressure regulators 26, 28 and 30, and is removably secured thereover to panel 32 as by screws 58. Stem 44 of regulator 28 projects through an aperture 60 in cover member 56 to receive the handle 54 outwardly of cover 56, whereas the stems 44 of the remaining pressure regulators are enclosed within cover 56.

To permit ready adjustment of the pressure differentials as between the various pressure regulators, each stem 44 may be provided with an elongated flat 62 for engagement by respective set screws 50. Accordingly, adjustment of the respective cell-to-cell pressure differentials would require only the removal of knob 54 (by loosening of a set screw 64), and removal of screws 58 to permit release of cover 56. Then, for any pressure regulator which is to be adjusted, the set screw 50 in the sprocket 48 on stem 44 thereof is loosened and a screwdriver utilized in an end slot 66 of the stem 44 to adjust the rotary position of the stem 44, and therefore the pressure setting of the respective pressure regulator. Once the new setting is etablished, the set screw 50 is re-tightened, and the cover 56 and knob 54 are reinstalled by reversing the above-described disassembly steps.

In order to provide a multiplicty of adjustment positions for each sprocket 48 with respect to the respective pressure regulator, each stem 44 may be provided with a plurality of circumferentially distributed flats 62. Alternatively, to provide for continuous adjustment capability, and to alleviate any difficulty encountered by individual adjustments as above described causing sprocket misalignment, stems 44 may be smooth surfaced if desired such that sprockets 48 slide and rotate freely thereon when the set screw 50 is not tightened down. This would permit adjustments to be made as above described without disturbing the alignment between the sprocket 48 on a given stem 44, and its mating drive sprocket on the stem 44 of the manually controlled pressure regulator 28.

Of course, the above description pertains to the presently contemplated best mode of the invention. I have contemplated various alternative and modified embodiments, and of course such would also occur to others versed in the art, once apprised of my invention. For example, the roller chain and sprocket drive arrangement could be substituted by a toothed flexible belt and complementing pulley arrangement; the multiplicity of pressure regulators may be more than three pressure regulators; the multiple pressure regulators could be laid out in a suitable pattern (e.g. at the apexes of a polygon) to permit a single roller chain or equivalent to pass about the respective drive sprockets installed on the stems of all such pressure regulators in a single circuit to provide the desired coordinated adjustment of the respective pressure regulators; and the like. These and other embodiments having been envisioned and anticipated, it is my intent that the invention be construed as broadly as permitted by the scope of the claims appended hereto.

I claim:

1. In an apparatus for promoting the flow of a body fluid within a part of a human body from a distal portion thereof toward a proximal portion thereof by conveying air pressure via plural pressure conveying means to respective inflatable cells of a multi-cell sheath which encompasses such a part of a human body so that the inflatable cells thereof form a sequence of cells extending between such distal and proximal portions, and to thereby inflate such cells for specified periods of time with the pressure applied in each such cell being greater than the pressure applied in the next adjacent cell toward such proximal portion, and less than the pressure applied in the next adjacent cell toward such distal portion such that the pressure applied therein produces a pressure gradient from maximum pressure adjacent such distal portion to minimum pressure adjacent such proximal portion, an apparatus for adjusting the magnitude of the applied pressure in such cells comprising:

a plurality of independently adjustable pressure regulators connected, respectively, in-line with the plural pressure conveying means supplying pressure to each such cell;

each said pressure regulator including movable pressure adjustment means for adjustment of the pressure setting of the respective said regulator;

one of said pressure regulators including manual actuator means associated with the said movable adjustment means thereof to permit adjustment by hand manipulation of the pressure setting of said one regulator;

drive means associated with each said movable adjustment means and operable to provide simultaneous adjustment of the pressure settings of all of said pressure regulators upon adjustment of the pressure setting of said one pressure regulator; and independent adjustment means associated with at least some of said pressure adjustment means to permit individual adjustment of the pressure setting of any of the respective said pressure regulators with respect to the pressure settings of any others of said pressure regulators independently of said simultaneous adjustment by operation of said drive means.

2. The apparatus as claimed in claim 1 wherein said drive means provides a drive ratio coordinated to each respective said pressure ragulator to maintain a constant pressure differential between the pressure settings of any given pair of said pressure regulators.

3. The apparatus as claimed in claim 2 wherein each said movable pressure adjustment means is a rotary adjustment means, and said drive means includes a chain and sprocket drive which is engageable in rotary driving engagement with each said rotary adjustment means.

4. The apparatus as claimed in claim 3 wherein said chain and sprocket drive includes an independent chain and sprocket drive for each movable pressure adjustment means.

5. The apparatus as claimed in claim 1 additionally including a cover means which covers all of said pressure adjustment means and said drive means, and exposing said manual actuator means for such hand manipulation thereof.

6. An apparatus for adjusting the pressure settings of a plurality of manually adjustable pressure regulators comprising:

a plurality of rotary adjusters associated with said pressure regulators, respectively, for adjusting the pressure setting thereof;

manual actuator means affixed to one of said rotary adjustors and operable to provide manual adjustment of the pressure setting of the respective one of said pressure regulators;

rotary drive means including rotary drive connectors which engage selected others of said rotary adjustors to provide rotary driving interconnection between said one of said rotary adjustors and said selected others of said rotary adjustors to provide for simultaneous adjustment of the pressure settings of the said respective pressure regulators in response to adjustment of said manual actuator means;

selectively operable release means associated with at least some of said rotary drive connections and operable to release the respective said others of said rotary adjustors from driving engagement with said rotary drive means; and said others of said rotary adjustors including other adjustment means which are cooperable with said release means to permit adjustment of said others of said rotary adjustors independently of said one rotary adjustor.

7. The apparatus as claimed in claim 6 wherein said rotary adjustors include elongated rotary shafts.

8. The apparatus as claimed in claim 7 wherein said rotary drive connections include sprockets engaged upon said rotary shafts.

9. The apparatus as claimed in claim 8 wherein said other adjustment means includes transversely slotted free end portions of the respective said rotary shafts.

10. The apparatus as claimed in claim 9 wherein said sprockets include hub portions and said release means includes set screw means threadedly engaged within said hub portions and engageable with the respective said rotary shafts.

11. The apparatus as claimed in claim 10 wherein said rotary shafts are externally threaded shafts and said hub portions include internal threads for threaded engagement of said sprockets on the respective said rotary shafts.

* * * * *